United States Patent [19]

Dellasso

[11] Patent Number: 4,834,138

[45] Date of Patent: May 30, 1989

[54] POOL COVER SYPHON FOR ABOVE GROUND POOLS

[76] Inventor: Vincent Dellasso, 8 Malibu La., Centereach, N.Y. 11720

[21] Appl. No.: 220,726

[22] Filed: Jul. 18, 1988

[51] Int. Cl.[4] ..... E03B 11/00

[52] U.S. Cl. ..... 137/590; 137/150; 137/546; 210/242.1

[58] Field of Search ..... 137/590, 150, 544, 546; 210/242.1

[56] References Cited

U.S. PATENT DOCUMENTS

| | | | |
|---|---|---|---|
| 154,158 | 8/1874 | Spooner | 210/242.1 |
| 1,230,971 | 6/1917 | Wilson | 137/150 |
| 1,582,399 | 4/1926 | Helander | 137/150 |
| 2,448,212 | 8/1948 | Dewey | 210/242.1 |
| 3,782,552 | 1/1974 | Wendell | 210/242.1 |
| 4,172,039 | 10/1979 | Akiyama | 210/242.1 |
| 4,647,374 | 3/1987 | Ziaylek et al. | 210/242.1 |

*Primary Examiner*—A. Michael Chambers

*Attorney, Agent, or Firm*—Richard L. Miller

[57] ABSTRACT

This pool cover sump screen device is particularly designed for above ground swimming pools for removing accumulated rain water in the cover. Primarily, it consists of a housing with a gravel containing compartment for weighing the housing down to keep it from moving, and a rain water intake compartment is adjacent and includes a tube that is secured in a flexible syphon hose extending down from the top of the swimming pool. A hand operated pump may also employed to start the sump screen device in its syphonning operation.

1 Claim, 1 Drawing Sheet

POOL COVER SYPHON FOR ABOVE GROUND POOLS

BACKGROUND OF THE INVENTION

The instant invention relates generally to swimming pool devices, and more particularly, to a pool cover pump devices for above ground pools.

Numerous drainage devices have been provided in the prior art that are adapted to syphon off water. For example, U.S. Pat. No. 4,318,421 of Ward, 3,184,764 of West, and 520,146 of Scanlon, all are illustrative of such prior art. While these units may be suitable for the particular purpose to which they address, they would not be as suitable for the purpose of the present invention as hereafter described.

SUMMARY OF THE INVENTION

A primary object of the present invention is to provide a pool cover syphon for above ground pools that will overcome the shortcomings of the prior art devices.

Another object is to provide a pool cover syphon for above ground pools that will be of such design, as to empty accumulated resin water from on top of a cover of a pool.

An additional object is to provide a pool cover syphon for above ground pools that will be so designed, as to drain unattended and will contain no mechanical or electrical parts.

A further object is to provide a pool cover syphon for above ground pools that is simple and easy to use.

A still further object is to provide a pool cover syphon for above ground pools that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
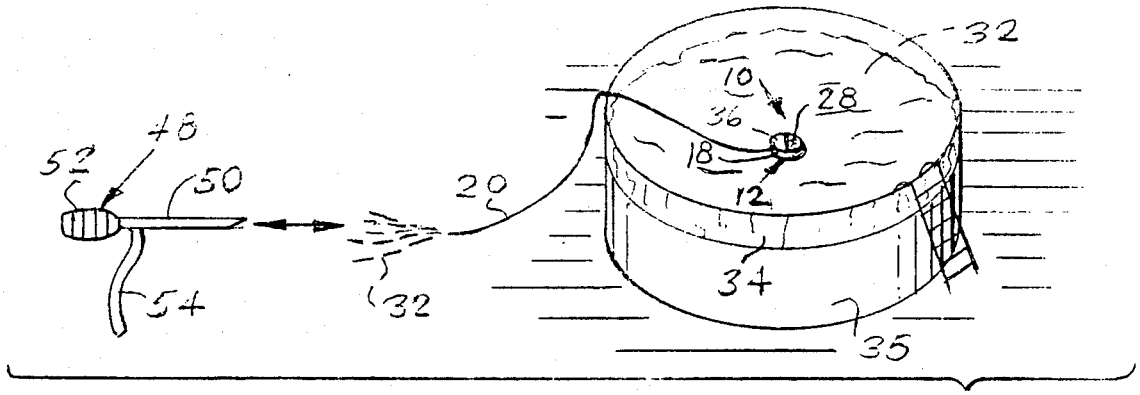
FIG. 1 is a diagrammatic perspective view of the instant invention shown in operative use.
Figure 2:
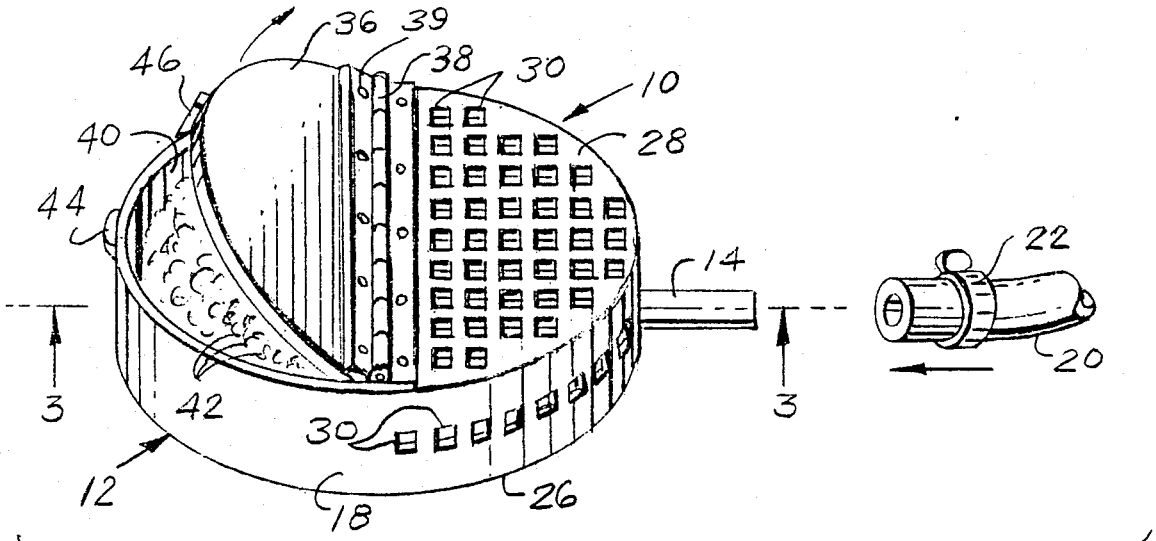
FIG. 2 is perspective view of the instant invention showing the cover partially lifted.
Figure 3:
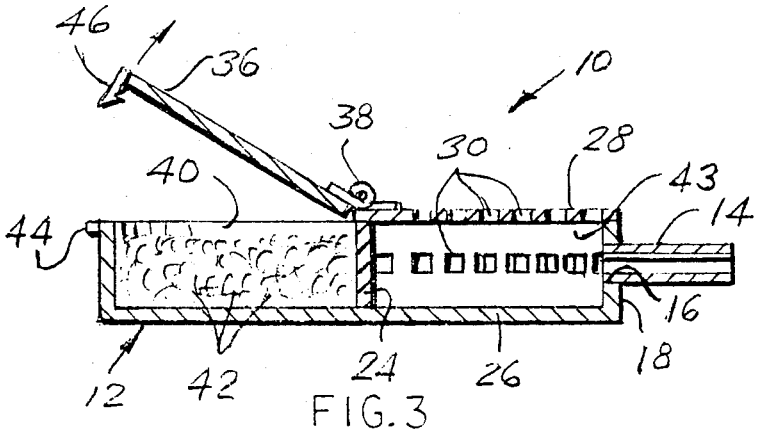
FIG. 3 is a cross sectional view taken on line 3—3 of FIG. 2.

Turning now descriptively to the drawing, in which like reference characters denote like elements throughout the several views, a sump screen device 10 is shown to include a housing 12 having a tube fitting 14 fixedly secured at one end in an opening 16 through a side wall 18. A flexible hose 20 is received on the other end of fitting 14 and is fastened thereto by an adjustable clamp 22. A divider wall 24 is fixedly secured to the inner periphery of side wall 18 and bottom wall 26 of housing 12, for a purpose which will hereinafter be described.

A top wall 28 is fixedly secured to a portion of housing 12 and is provided with a plurality of spaced openings 30, as are also provided through a wall portion of housing 12, the openings 30 providing for input flow of rain water 32 that accumulates in the top of pool cover 34 covering outdoor pool 35, while at the same time preventing leaves and other large debris immersed in the water from clogging the sump screen device and making it inoperative. A pivotal cover 36 is provided and is secured to top wall 28 by a hinge 38 fastened by fasteners 39. This pivotal cover 36 provides for covering compartment 40 for containing a quantity of ballast gravel 42 that serves to weigh housing down to prevent its moving, when sump screen device 10 is in operation and the input flow of rain water 32 is entering the adjacent second compartment 43.

A lip 44 is fixedly secured to outer periphery of the rim portion of housing 12 and provided for latching engagement with a latch hook 46 that is fixedly secured to the outer peripheral edge of pivotal cover 36, the combination of the lip 44 and the latch hook 46, providing for keeping the gravel 42 confined in the compartment 40.

A typical check valve and bulb pump 48 is provided for starting sump screen device 10, and includes an input tube 50 secured in a squeeze bulb 52, and a flexible discharge the 54 is fixedly secured at one end to a rear portion of input tube 50.

In operation, housing 12 is placed as near to the center portion of the rain water 32 accumulated on cover 34, with the top wall 28 facing upward. The unattached end of the flexible hose 20 is depended downward from the side of the pool 35, and the tube 50 is forced into the hose 20. After the above, the operator squeezes the bulb 52 to cause a differential in pressure and the rain water 32 will then begin to flow through openings 30, the hose 20, and out of the discharge tube 54. When the above occurs, the pump 48 is then removed and the rain water 32 will continue to flow out from the cover 34 of the pool 35.

While certain novel features of this invention have been shown and described and are pointed out in the annexed claims, it will be understood that various omissions, substitutions and changes in the forms and details of device illustrated and in its operation can be made by those skilled in the art without departing from the spirit of the invention.

What is claimed is:

1. A pool cover sump screen device for above ground pools, comprising, a housing, for placement in a center most area of a top of a pool cover, a pair of compartments provided in said housing, for receiving gravel and rain water, a pivotal cover secured to said housing, for confining said gravel, and a tube secured to said housing, for coupling to a flexible output hose for outward flow of rain water from said top of said pool cover, wherein a divider wall is fixedly secured to an inner peripheral surface of a side wall of said housing, a bottom wall of said housing, and a top wall of said housing, and defines a first compartment that receives said gravel that provides ballast weight for keeping said housing immersed below water down on said top of said pool cover, wherein said top wall is fixedly secured to a top of said housing and covers a second compartment defined in said housing, and a plurality of spaced openings are provided through said top wall and a portion of said side wall of said housing adjacent to said top wall, allowing rain water from said top of said pool cover to enter said second compartment and out of said tube fitting when said sump screen device is in operation while preventing debris from clogging said sump screen device, wherein said pivotal cover is secured by a hinge to a top of said top wall, and said hinge is secured to said top wall and said pivotal cover by fasteners, and a latch hook is fixedly secured at one end to an outer peripheral edge of said pivotal cover and extends downward and mechanically engages with a lip fixedly secured to and projecting from an outer periphery of said side wall of said housing.

* * * * *